US005816309A

United States Patent [19]

Paradise

[11] Patent Number: 5,816,309

[45] Date of Patent: Oct. 6, 1998

[54] DOOR EDGE GUARD

[75] Inventor: Bruce D. Paradise, Avon, Conn.

[73] Assignee: The Stanley Works, New Britain, Conn.

[21] Appl. No.: 623,366

[22] Filed: Mar. 28, 1996

[51] Int. Cl.[6] ..... E05D 15/26

[52] U.S. Cl. ..... 160/206; 160/40; 160/199; 49/368; 52/71; 16/86 R; 292/DIG. 21; 292/DIG. 70

[58] Field of Search ..... 160/40, 199, 206; 49/368, 367, 366, 489.1, 484.1; 52/71, 238.1, 64; 16/86 R, 86 A; 292/202, 238, DIG. 21, DIG. 15, DIG. 17, DIG. 19, DIG. 70, 285, 304, DIG. 41, 48

[56] References Cited

U.S. PATENT DOCUMENTS

| | | | |
|---|---|---|---|
| 504,263 | 8/1893 | Adams | 292/238 |
| 3,029,481 | 4/1962 | Henniges | 49/489.1 X |
| 3,077,250 | 2/1963 | Goldberg | 49/484.1 |
| 3,156,293 | 11/1964 | Reynolds | 160/40 |
| 3,161,229 | 12/1964 | Sanders | 160/40 |
| 3,408,772 | 11/1968 | Frehse | 49/366 |
| 3,594,030 | 7/1971 | Paetz | 292/285 X |
| 3,788,689 | 1/1974 | Lloyd | 292/304 |
| 3,831,988 | 8/1974 | Stelma | 292/DIG. 41 |
| 3,919,808 | 11/1975 | Simmons | 49/367 |
| 4,034,511 | 7/1977 | Bursk | 49/489.1 |
| 4,226,489 | 10/1980 | Haag | 49/366 X |
| 4,265,051 | 5/1981 | Williams | 49/367 X |
| 4,850,144 | 7/1989 | Grisham et al. | 49/484.1 X |
| 4,970,829 | 11/1990 | Brautigam | 49/489.1 |
| 5,107,622 | 4/1992 | Fuchs et al. | 49/484.1 |
| 5,141,266 | 8/1992 | Braun et al. | 292/48 X |
| 5,199,478 | 4/1993 | Kubota | 160/40 |
| 5,289,657 | 3/1994 | Kiel | 49/484.1 X |
| 5,383,701 | 1/1995 | Okada | 49/368 X |
| 5,450,694 | 9/1995 | Goranson et al. | 52/238.1 X |
| 5,499,475 | 3/1996 | Court et al. | 49/368 X |
| 5,551,499 | 9/1996 | McRoberts | 160/199 X |

FOREIGN PATENT DOCUMENTS

| | | | |
|---|---|---|---|
| 1126583 | 6/1982 | Canada | 49/484.1 |
| 81288 | 6/1983 | European Pat. Off. | 49/489.1 |
| 678303 | 6/1939 | Germany | 49/484.1 |
| 366658 | 2/1963 | Switzerland | 49/484.1 |

*Primary Examiner*—Harry C. Kim
*Assistant Examiner*—Bruce A. Lev
*Attorney, Agent, or Firm*—Alix, Yale & Ristas, LLP

[57] ABSTRACT

A door edge guard for mounting to the leading edges of a pair of bifold doors has a guard body. The guard body has a rear wall, a front wall spaced apart from the rear wall and resiliently deformable panels extending between the front and rear walls. The front wall, rear wall and side panels define a crush zone therebetween. Weather stripping extends forwardly from the front wall to provide a weather barrier.

14 Claims, 4 Drawing Sheets

DOOR EDGE GUARD

BACKGROUND OF INVENTION

This invention relates generally to the field of folding door systems. More specifically, this invention relates to structures at the leading edges of folding doors.

The use of bifold doors is well known in the field of automatic door systems. These doors typically employ a pair of oppositely positioned doors which are movable between opened and closed positions. Each door comprises at least two hinged panels pivotally mounted to a door frame. In the closed position, the doors form a pair of adjacent, opposed rigid leading edges. The leading edges typically do not contact one another in the closed position. A gap is maintained between the leading edges for clearance during door operation and to allow for contraction and expansion of components. Weather stripping may be mounted on each leading edge to close the gap between the leading edges. The weather stripping functions in a conventional manner to reduce drafts and infiltration of outside air that would increase interior heating or cooling demands. Additionally, the weather stripping prevents light from passing through the gap and thus presents a more aesthetically appealing appearance to the door system.

An automatic operator system typically controlled by a sensing device opens and closes the pair of doors. Conventionally, proximity sensors or other sensor systems prevent closure of the doors when an object or person is located therebetween. However, under some circumstances, the doors can approach the closed position or be fully closed before an object is detected between the door edges. For folding door systems, the compressive force components exerted by the leading edges are greatly increased as the doors approach the closed position because of the small fold angles which approach zero. Therefore an object can be caught or pinched between the rigid leading edges of the doors and subject to substantial compressive forces.

SUMMARY OF THE INVENTION

Briefly stated, the door edge guard of the invention has a resiliently deformable guard body defining a crush zone. The guard body has spaced apart front and rear walls with the rear wall being positioned at the leading edge of the door. Resiliently deformable sidewalls extend between the front and rear walls. The front, rear and side walls define a crush zone therebetween. A weather barrier extends from the guard body. In a preferred embodiment, a weather strip extends from the front wall to engage a similar weather strip on an oppositely positioned door guard of an oppositely positioned door.

Two spaced apart longitudinal weather strip slots are molded in the front wall of the door edge guard to support weather strips on the front wall. The weather strip slots extend from the top to the bottom of the door in a direction generally parallel to the vertical leading edge of the door. Each slot has a T-shaped cross-section to receive a flat rail of weather strip material. The flat rail of the weather strip slidably engages each T-shaped weather strip slot. A pile strip extends outwardly from the rail to provide a weather barrier between the doors.

The door edge guards of the invention are affixed to each leading edge of the cooperative bifold doors. Preferably, the leading edge of each door defines a pair of spaced apart longitudinal mounting slots extending from the top to the bottom of the doors along a vertical axis. The mounting slots have a generally T-shaped cross section. Extending from the rear wall of the door edge guards are pairs of spaced apart mounting feet having generally the same cross-sectional profile as the mounting slots. The mounting feet slidably engage in the mounting slots to support the door edge guards on the leading edge of each door.

The oppositely positioned doors are arranged to provide a gap between the guard bodies of the door edge guard when the doors are in the closed position. The weather strips extend from each door edge guard to preferably contact the oppositely positioned weather strips. Therefore, the contacting weather strips provide a weather barrier to prevent the transmission of light and outside air.

In use, should an object become captured between the leading edges of the door, the resiliently deformable door edge guards collapse to create additional space between the front walls of the door edge guards. The additional space reduces the potential for damage to the object caught therebetween. Once the doors have opened or the object is removed, the sidewalls resiliently return to their original shape to again provide a weather barrier to prevent transmission of light or air when the doors are in the closed position.

In addition, an opening can be provided in each door edge guard for a novel door lock to lock together the leading panels of the doors. The door lock has an extendable strike assembly, and a latch assembly engageable to the strike assembly. The strike assembly has a strike arm swingable outwardly in an arced path from one of the leading edges of one of the doors. The strike arm extends through the opening in the door edge guard. In the opposite door, a latch swings in an arced motion from the leading edge through an opening in the other door edge guard to engage a strike opening in the strike arm and therefore lock the doors together.

An object of the invention is to provide a door edge guard for a folding door which allows the door to close on an object without damaging the object.

Another object of the invention is to provide a door edge guard for a leading edge of a folding door, which guard effectively eliminates any leading edge gap in the closed position.

Another object of the invention is to provide a door edge guard that provides an effective barrier to the infiltration of outside air between the leading edges of a door system.

A still another object of the invention is to provide a door edge guard that may be installed in an efficient and cost effective manner.

A yet another object of the invention to provide a door lock system that extends between the leading edges of the door to provide an efficient locking function.

These and other objects and advantages of the invention will become apparent from the drawings and the specification.

DETAILED DESCRIPTION OF THE PREFERRED EMBODIMENT

Figure 1:
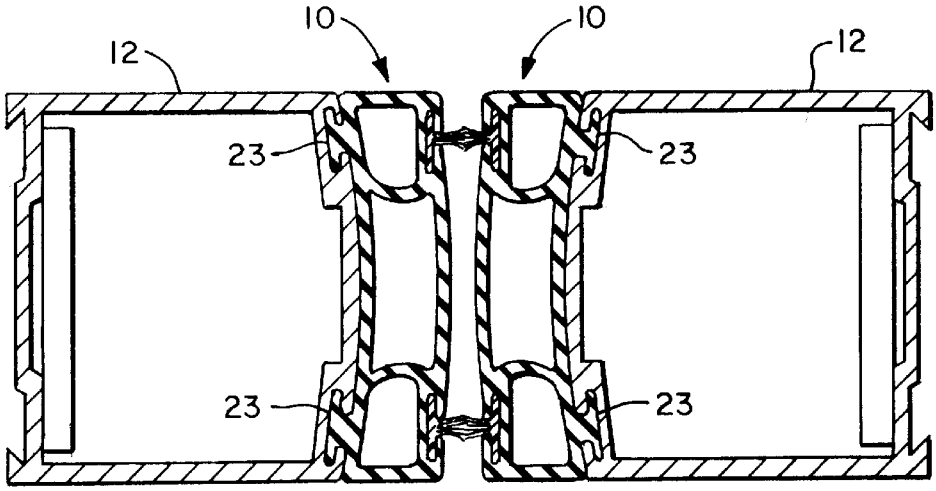
FIG. 1 is a top cross-sectional view of a pair of door edge guards of the invention mounted to a pair of door stiles of a folding door system wherein said stiles are in the closed position.
Figure 2:
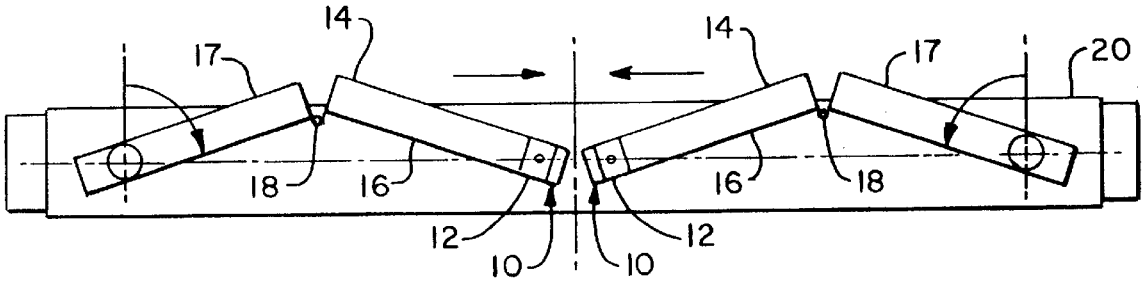
FIG. 2 is a schematic top view of a bifold door system incorporating the door edge guards of FIG. 1 and illustrating a closing sequence.

With reference to the drawings wherein like numerals represent like parts throughout the figures, a door edge guard, designated generally by the numeral 10, is mounted to the leading edge 22 of a bifold door 14. Each door 14 has at least a pair of panels 16, 17 interconnected by hinges 18. The door edge guard 10 functions as a protective structure and as a weather barrier. The door edge guard 10 of the invention is also compatible with single or double, swinging or sliding doors.

The doors 14 are mounted to a door frame 20 to swing from an open position wherein the panels 16, 17 of each door 14 are in a folded position to a closed linear position wherein the leading edges 22 of each door 14 are in generally opposing adjacent relationship. The leading edges 22 are defined by a vertical door stile 12 on each door 14. The door stiles 12 are preferably formed of a rigid metal extrusion and extend longitudinally from the top to the bottom of each door 14. A pair of transversely spaced, longitudinally extending vertical mounting slots 23 for mounting the door edge guards are formed in the leading edge 22 of each door stile 12. Each mounting slot 23 has a T-shaped cross-section for receiving the door edge guard 10.

Each door edge guard 10 has an elongated guard body 24. The guard body 24 is preferably constructed of a resiliently deformable rubber that, over a substantial operational range, yields when a force is applied and generally returns to its original shape upon removal of the force. The guard body 24 is manufactured by an extrusion process to form a unitary member. The guard body 24 is preferably dimensioned to extend as a single piece from the top to the bottom of the door stile 12 along substantially the entire leading edge 22.

The guard body has a rear wall 28 that generally contacts the leading edge 22. A front wall 30 is spaced apart from the rear wall 28. A pair of resiliently deformable side walls 32 interconnects the rear wall 28 and front wall 30. The rear wall 28, front wall 30 and side walls 32 define an internal crush zone 34 therebetween. The side walls 32 resiliently deform to allow movement of the front wall 30 into the defined crush zone 34. The crush zone 34 is substantially open volume that can receive the front wall 30 and side walls 32 as they deform to prevent pinching or damaging an object caught between the doors 14 in the closed position. It is additionally preferable that the front wall 30 is itself resiliently deformable to further increase the flexibility of the guard body 24 and thereby prevent damage to objects forced against the door edge guard 10.

Figure 3:
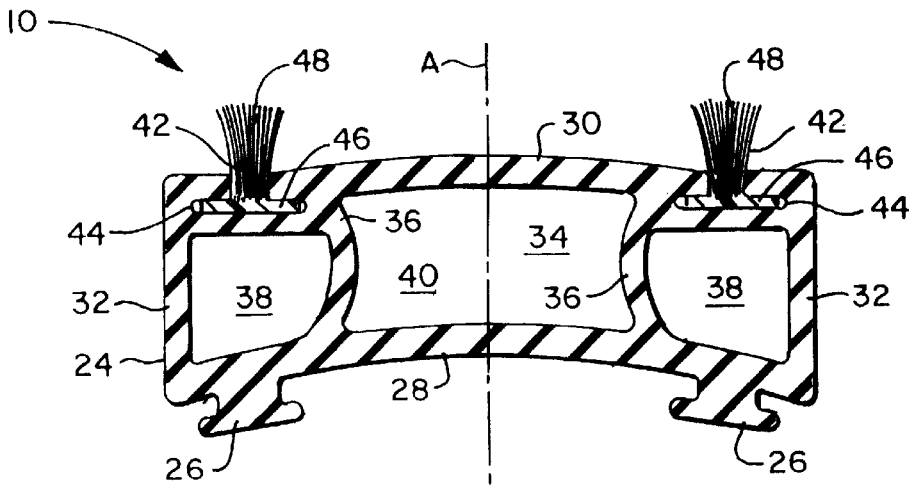
FIG. 3 is an enlarged cross-sectional view of the door edge guard of FIG. 1.
Figure 4:
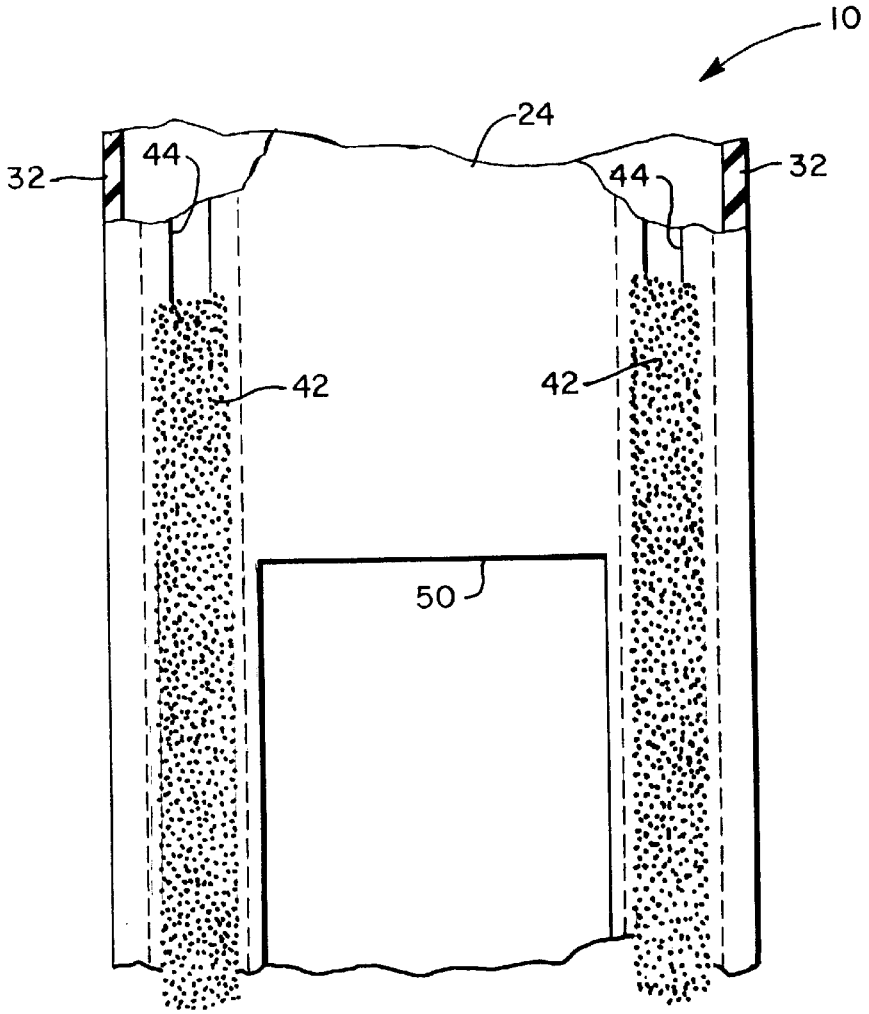
FIG. 4 is a fragmentary front elevational view, partially in phantom and portions removed, of the door edge guard of FIG. 3.
Figure 5:
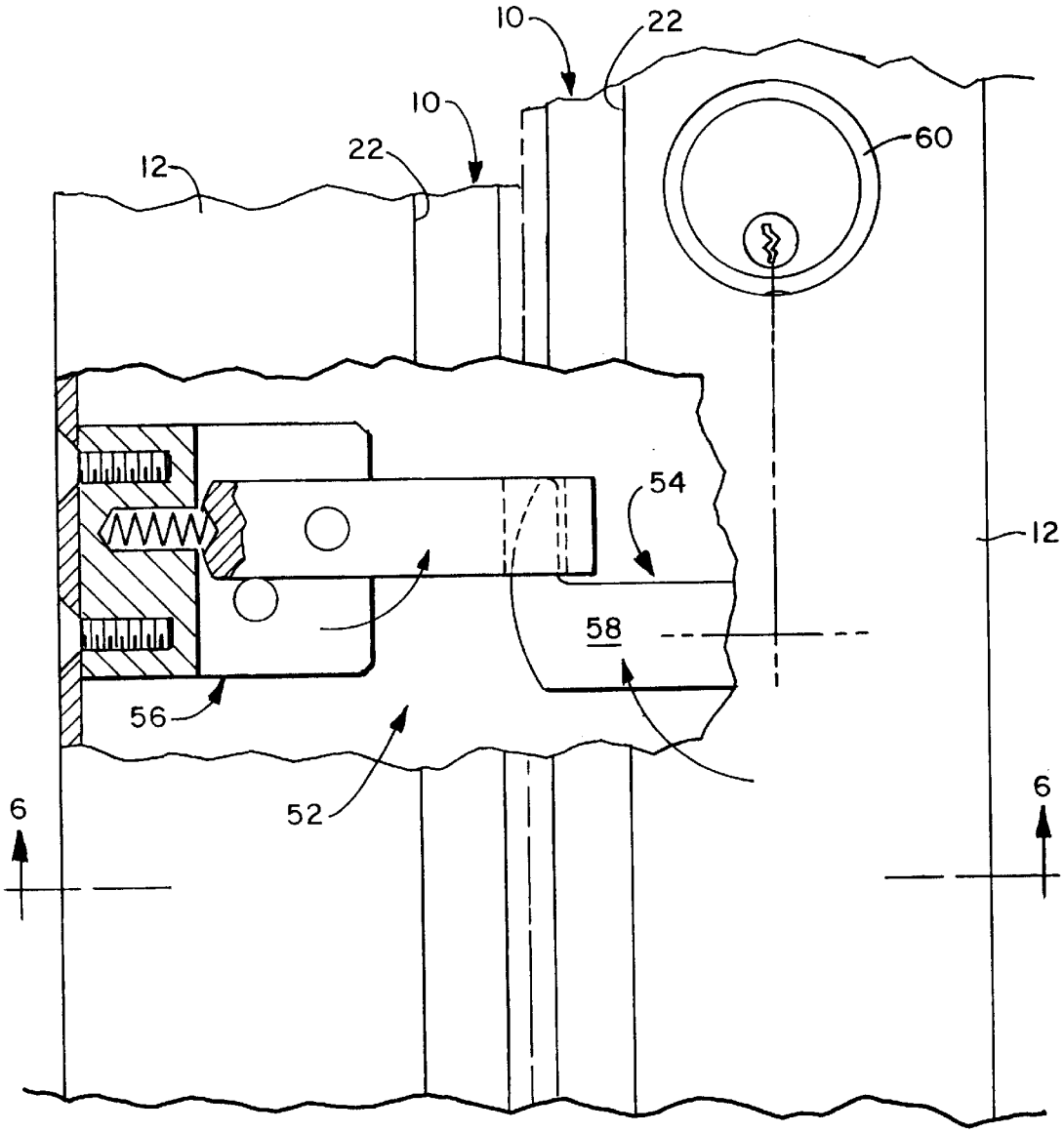
FIG. 5 is a fragmentary side elevational view, partially in section and partially in phantom, of a pair of door stiles, door edge guards and a locking mechanism of the invention.
Figure 6:
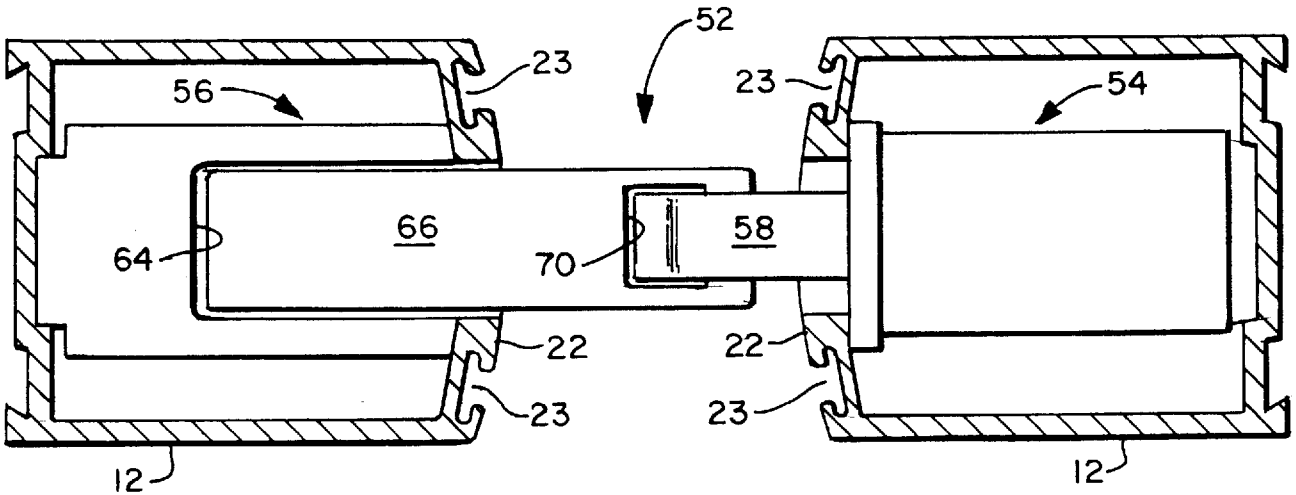
FIG. 6 is a cross-sectional view of the door stiles and locking mechanism of FIG. 5 taken along the line 6—6 thereof.
Figure 8:
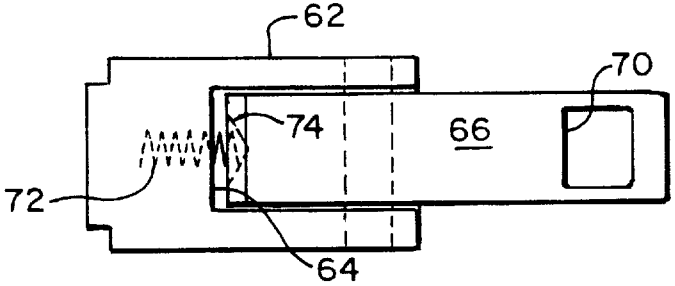
FIG. 8 is a top plan view, partially in phantom of the strike mechanism of FIG. 6.
Figure 7:
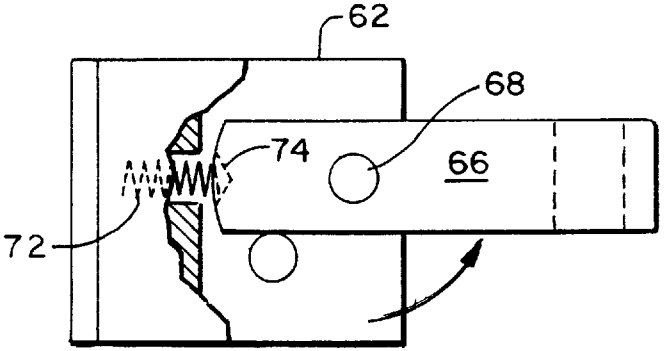
FIG. 7 is a side elevational view, partially in phantom, of the strike mechanism of FIG. 6.

Internal buttresses 36 are integrally molded into the guard body 24 to assist in maintaining the front wall 30 in a spaced apart relation from the rear wall 28. The internal buttresses 36 provide additional structural integrity to the guard body 24. The internal buttresses 36 are preferably positioned equidistantly from a center line A generally perpendicular to the leading edge 22 and along the entire line of the guard body. (See FIG. 3.) The internal buttresses 36 are furthermore preferably positioned closer to the side walls to divide the crush zone into three cells, two outer crush cells 38 and an intermediate crush cell 40.

Each outer crush cell 38 is defined by the front wall 30, the rear wall 28, one of the side walls 32, and one of the internal buttresses 36 positioned closest to the particular side wall 32. The intermediate crush cell 40, which is preferably larger than either outer crush cell 38, is defined by the rear wall 28, the front wall 30 and the internal buttresses 36. The intermediate crush cell 40 is more resilient relative to the outer crush cells 38. The closely spaced relationship of the side walls 32 and the internal buttresses 36 produces a stiffer or more force resistant guard body portion around the outer crush cells 38. The relatively more rigid constructions adjacent the outer crush cells 38 provide support for a pair of weather strips 42 to extend from the guard body 24.

Each weather strip 42 has a flat weather strip rail 46 and a pile strip 48 extending perpendicularly from the weather strip rail 46. The pile strip 48 extends in front of the front wall 30 to provide a weather barrier between the guard body 24 and another door edge guard 10, a door frame or other oppositely positioned structure. The guard body 24 defines a pair of spaced apart, longitudinally extending slots 44 having a T-shaped cross-section. Each weather strip rail 46 preferably slidably engages in a corresponding weather strip slot 44. The weather strips 42 can be rapidly and efficiently replaced on the guard body 24 by sliding out the worn weather strips and sliding in a replacement weather strip. The weather strips 42 are maintained in position on the guard body 24 by an interference fit between the weather strips 42 and the weather strip slots 44. The weather strip rails 46 may also have an adhesive to maintain the weather strips 42 in position on the guard body 24. In use the weather strips 42 of each oppositely positioned door edge guard 10 are in contact when the doors 14 are in the closed position. The contact of each pair of weather strips 42 produces a double weather barrier to the passage of light and air between the door edge guards 10. (See FIG. 1.)

A pair of transversely spaced, longitudinally extending mounting feet 26 projects from the rear wall 28 of the guard body 24 for supporting the door edge guard 10 against the leading edge 22 of the door stile 12. The mounting feet 26 slidably engage the mounting slots 23 of the door stile 12. Sliding the mounting feet 26 in the mounting slots 23 allows for rapid and simplified installation or removal of the door edge guard 10. The door edge guard 10 is maintained in position on the leading edge 22 of the door 14 by an interference fit between the mounting feet 26 and the mounting slot 23. The weather strip rails 46 and mounting feet 26 have generally the same cross-sectional dimensions. Adhesives or hardware (neither illustrated) can additionally be used to maintain the door edge guard 10 in position on the door 14.

The doors 14 can be locked together in a closed position by a lock assembly 52 extending from the door edge stiles 12 and through the door edge guards 10. Conventional lock devices for the folding doors may prove inoperative with the use of the door edge guards 10. The lock assembly 52 comprises a latch assembly 54 positioned in one door edge stile and a strike assembly 56 positioned in the opposite door edge stile. Portions of the front walls 30 and the rear walls 28 of each guard body 24 are partially removed to form lock openings 50 for the latch assembly 54 and the strike assembly 56.

The latch assembly 54 has a latch arm 58, movable in an arced path, from a position within the door 14, to a position wherein the latch arm 58 extends beyond the guard body 10. The latch arm 58 is pivoted and locked in position by a conventional key-operated cylinder lock 60 or other locking system.

The strike assembly 56 has a generally U-shaped strike body 62 defining a strike arm opening 64. An elongated strike arm 66 is pivotally mounted in the strike arm opening 64. The strike arm 66 rotates on a pivot 68 extending between the walls of the strike body 62. The strike arm 66 swings from a concealed position generally within the door 14 and parallel to the leading edge 22 to a second operative position generally orthogonal to the leading edge 22. The strike arm 66 defines a strike opening 70 for receiving the latch arm 58. The strike arm 66 is dimensioned to position the strike opening 70 approximately equidistantly between the opposed leading edges 22. A spring-loaded detent mechanism 72 mounted in the strike body engages a detent 74 in the rear portion of the strike 66 to support the strike 66 in the extended operative position. The detent 74 is preferably positioned at the end of the strike 66 opposite the latch opening 70.

The lock assembly 52 is initially activated while the doors 14 are in the open position. The strike arm 66 is pivoted in an arced path upward from the position parallel with the leading edge 22 of the door 14 to a position generally orthogonal to the leading edge 22. The strike 66 is held in an extended position by the detent mechanism 72 engaging the detent 74. The doors 14 are moved to the closed position wherein the leading edges 22 of each door 14 are in opposite relation. The latch arm 58 is rotated upwardly via the key-operated cylinder lock and latches through the opening 70 in the strike 66 to lock the doors 14 in the closed position.

While a preferred embodiment of the invention has been shown and described, various modifications and substitutions may be made thereto without departing from the spirit and scope of the invention. Accordingly, it is to be understood that the present invention has been described by way of illustration and not limitation.

What is claimed is:

1. A door edge guard for the leading edge of a door, said guard comprising:

an elongated guard body having a rear wall positionable on said leading edge, a front wall spaced from said rear wall and defining a weather strip engagement slot having a T-shaped cross-section, a pair of transversely spaced side panels extending between said rear wall and said front wall, said side panels being resiliently deformable, said front wall, said rear wall and said side panels defining an elongated crush zone, and guard body mounting means comprising two transversely spaced mounting feet having a T-shaped cross-section for mounting said guard body to said leading edge; and weather strip means for providing a weather barrier, said weather strip means extending from said front wall and comprising strip mounting means comprising a rail engaged in said slot for selectively replaceably mounting said weather strip means to said guard body.

2. The door edge guard of claim 1 wherein said weather strip means comprises a weather strip pile extending from said front wall.

3. The door edge guard of claim 1 wherein said front wall defines a weather strip engagement slot having a T-shaped cross-section, and said weather strip mounting means comprises a rail captured in said weather strip engagement slot.

4. The door edge guard of claim 1 wherein said guard body mounting means comprises a pair of transversely spaced mounting feet extending from said rear wall.

5. The door edge guard of claim 4 wherein said mounting feet have a T-shaped cross-section.

6. The door edge guard of claim 1 further comprising a plurality of internal support structures in said crush zone, said support structures extending between said rear wall and said front wall, said support structures being resiliently deformable.

7. The door edge guard of claim 6 comprising two transversely spaced internal support structures which define two transverse outer cells and an intermediate cell intermediate said outer cells and wherein said intermediate cell is less crush resistant than said outer cells.

8. The door edge guard of claim 1 wherein said front wall is resiliently deformable.

9. A protective door system comprising:

a door having a vertical stile defining a leading edge; and a door edge guard mounted to said leading edge, said door edge guard comprising a guard body having a front wall defining a weather strip slot and forwardly spaced from said leading edge, a pair of side panels extending between said leading edge and said front wall, said side panels being resiliently deformable, said front wall and said side panels defining an elongated crush zone, and guard mounting means for mounting said door edge guard to said stile, and a weather strip member comprising a weather strip pile extending from said front wall for providing a weather barrier, said weather strip member comprising strip mounting means for mounting said weather strip member in said weather strip slot.

10. The door system of claim 9 wherein said door stile comprises an extruded rigid metal member, said member defining two transversely spaced longitudinal mounting slots and said guard mounting means comprises two spaced mounting feet extending from said guard body and engaged in said mounting slots.

11. The door system of claim 10 wherein said mounting slots have a T-shaped cross-section.

12. The door system of claim Wherein said front wall defines a weather strip engagement slot having a T-shaped cross section and said strip mounting means comprises a rail engaged in said weather strip engagement slot.

13. A folding door system comprising:

a door frame;

a pair of oppositely positioned folding doors mounted to said frame, each said door having a first panel, a second panel and hinge means for swingingly connecting said first panel and said second panel, said doors defining a closed position and said doors defining opposing leading edges in said closed position;

a door edge guard affixed to said leading edge of each said door, each said door edge guard comprising an elongated guard body generally parallel to said leading edges, said guard body having a front wall spaced forwardly from said respective door leading edge, side panels extending between said leading edge and said front wall, said side panels being resiliently deformable, guard mounting means for mounting said guard body to said leading edge and weather strip means for providing a weather barrier extending forwardly from said front wall, said door edge guards being in contact when said doors are in said closed position;

lock means for locking said first door panels together when said doors are in said closed position, said lock means comprising a strike means extendable from one of the said first panels and a latch means extendable from said other first panel for latching engagement with said strike means and said leading edges defining a longitudinal axis and said strike menas swings from a position generally parallel to said axis to an extended position generally orthogonal to said axis and said latch means swings from a position generally parallel to said axis to an extended position generally orthogonal to said axis.

14. The folding door system of claim 13 wherein said strike means comprises a detent means to hold strike in said extended position.

* * * * *

UNITED STATES PATENT AND TRADEMARK OFFICE

CERTIFICATE OF CORRECTION

PATENT NO. : 5,816,309
DATED : October 6, 1999
INVENTOR(S) : Bruce D. Paradise

It is certified that error appears in the above-identified patent and that said Letters Patent is hereby corrected as shown below:

Column 6,
Line 40, "claim Wherein" should read -- claim 11 wherein --.

Column 8,
Line 5, insert -- said -- after "hold".

Signed and Sealed this

Thirtieth Day of November, 2004

JON W. DUDAS
*Director of the United States Patent and Trademark Office*